US009080370B2

(12) United States Patent
Cardona

(10) Patent No.: US 9,080,370 B2
(45) Date of Patent: Jul. 14, 2015

(54) DEVICE FOR BLOCKING A PASSAGE

(75) Inventor: Yvan Cardona, Perpignan (FR)

(73) Assignee: LIBERVIT, Perpignan (FR)

( * ) Notice: Subject to any disclaimer, the term of this patent is extended or adjusted under 35 U.S.C. 154(b) by 627 days.

(21) Appl. No.: 13/266,809

(22) PCT Filed: Apr. 8, 2010

(86) PCT No.: PCT/FR2010/050675

§ 371 (c)(1),
(2), (4) Date: Oct. 28, 2011

(87) PCT Pub. No.: WO2010/125270

PCT Pub. Date: Nov. 4, 2010

(65) Prior Publication Data

US 2012/0048482 A1 Mar. 1, 2012

(30) Foreign Application Priority Data

Apr. 30, 2009 (FR) ..... 09 52873

(51) Int. Cl.
*E06B 9/02* (2006.01)
*E06B 9/06* (2006.01)
*E06B 9/00* (2006.01)

(52) U.S. Cl.
CPC ..... *E06B 9/02* (2013.01); *E06B 9/0692* (2013.01); *E06B 2009/002* (2013.01)

(58) Field of Classification Search
CPC .... E06B 9/02; E06B 9/0692; E06B 2009/002
USPC ..... 160/216, 221, 223, 224, 225; 52/202; 248/200.1, 354.2, 354.1; 49/55, 56, 57
See application file for complete search history.

(56) References Cited

U.S. PATENT DOCUMENTS

| | | | | | |
|---|---|---|---|---|---|
| 1,587,604 | A * | 6/1926 | Schling | 160/224 |
| 1,734,415 | A * | 11/1929 | Bierfield | 160/105 |
| 1,891,588 | A * | 12/1932 | Claus | 410/151 |
| 3,787,019 | A * | 1/1974 | Freitag | 248/188.2 |
| 4,400,911 | A * | 8/1983 | Bell et al. | 49/55 |
| 4,492,263 | A | 1/1985 | Gebhard | |
| 4,817,334 | A * | 4/1989 | Badger et al. | 49/55 |
| 6,394,405 | B1 * | 5/2002 | Roxton et al. | 248/354.1 |
| 6,746,183 | B1 * | 6/2004 | Sullivan | 405/272 |
| 6,910,312 | B2 * | 6/2005 | Whitworth | 52/741.3 |
| 6,953,076 | B2 * | 10/2005 | Whittemore | 160/368.1 |

FOREIGN PATENT DOCUMENTS

| | | |
|---|---|---|
| CH | 428 118 A | 1/1967 |
| FR | 2360073 A1 | 2/1978 |

(Continued)

*Primary Examiner* — David Purol
(74) *Attorney, Agent, or Firm* — Lucas & Mercanti, LLP

(57) ABSTRACT

The present invention relates to a self-contained protection device (1, 1*a*-1*b*) for provisionally blocking a passage (10) such as a corridor, a door, or a window, characterized in that it includes at least one longitudinally-extendable bar (2, 2*a*-2*b*), preferably a telescopic bar, the extension thereof being actuatable by an actuator (3), said bar being capable of being removably locked in an extended configuration between two wall surfaces (10*a*, 10*b*) defining said passage, referred to as locking surfaces, said extendable bar supporting one or preferably a plurality of blocking member(s) (4) to form a protection screen (5, 5*a*, 5*b*) blocking said passage, in which said blocking member(s) is or are preferably removably fixed.

15 Claims, 7 Drawing Sheets

(56) References Cited

FOREIGN PATENT DOCUMENTS

Figure 1A:
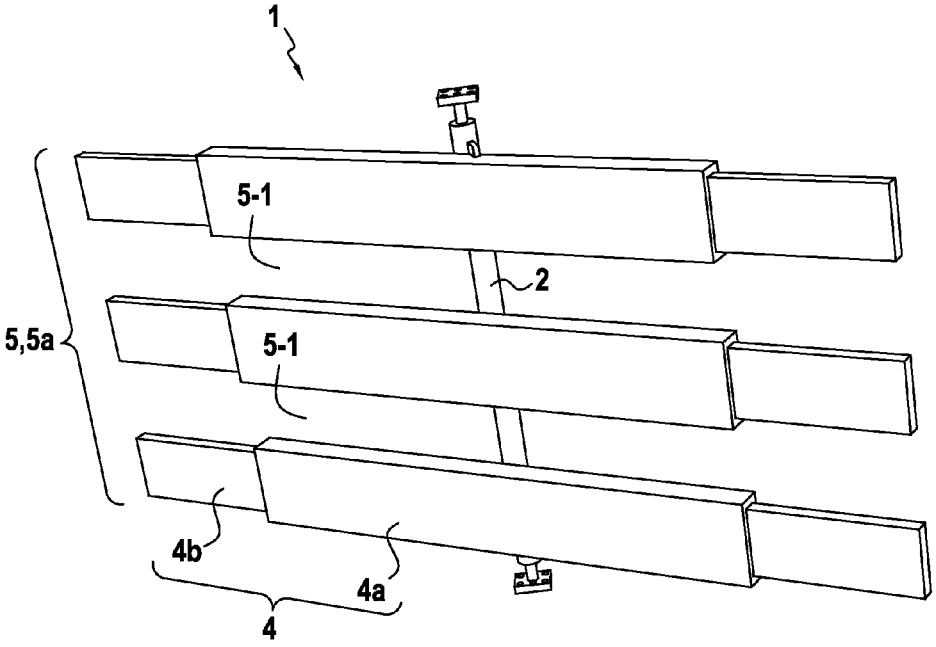

| | | | |
|---|---|---|---|
| FR | 2647497 | A1 | 11/1990 |
| FR | 2661449 | A1 | 10/1991 |
| FR | 2814230 | A1 | 3/2002 |
| WO | 94/20723 | A1 | 9/1994 |

* cited by examiner

DEVICE FOR BLOCKING A PASSAGE

This application is a 371 of PCT/FR2010/050675 filed Apr. 8, 2010, which in turn claims the priority of FR 0952873 filed Apr. 30, 2009, the priority of both applications is hereby claimed and both applications are incorporated by reference herein.

The present invention relates to a self-contained protection device for temporarily blocking a passage such as a corridor, a door, or a window.

Various systems of removable anti-intruder grilles for openings in buildings are known and even systems aiming to prevent defenestration. However, those systems require either mechanical fixing means on the frame of the openings in question, which means are relatively time-consuming to produce, or they require adaptation of the frame of the opening for the closure concerned. Those grilles are generally heavy and difficult to manipulate, and furthermore they include relatively complex locking systems, especially in FR 2 647 497, FR 2 661 449.

Roller shutter-type systems have also been proposed, notably in FR 2 360 073, WO 94/20723, and FR 2 814 230. However, those systems also require mechanical fixing means on the reveals of the openings to be blocked.

The present invention relates more particularly to a protection device intended for security personnel, such as law enforcement, police, armed police, or army personnel, notably rapid response teams.

The objective of the present invention is to provide a device for temporarily blocking a passage such as an opening or a corridor in order to prevent or delay entry into that passage of consenting or non-consenting persons and/or to prevent the projection of objects through said device, notably from the outside toward the inside or from the inside toward the outside if the device is placed against a door or window. This type of device more particularly aims to prevent suicidal defenestration while negotiating with disturbed persons, but also to channel persons by temporarily blocking certain passages, for example corridors, during demonstrations or movements of crowds in public or private places.

To be more precise, one object of the present invention is to provide a self-contained protection device of this type that is easy and above all quick to fix and remove for intervention personnel (referred to below as operators), in order to minimize the time for which intervention personnel are exposed to the risk of projectiles and/or attack while installing the device.

The applicant has stated the problem in the above terms for the first time. No device of this type suited to the uses referred to above is currently available commercially or used publicly by security organizations such as the police or the army.

To this end, the present invention provides a self-contained protection device for temporarily blocking a passage such as a corridor, a door, or a window, characterized in that it comprises at least one longitudinally-extendable bar, 1.5 preferably a telescopic bar, adapted to be actuated in extension by an actuator, said bar being adapted to be removably locked when extended between two wall surfaces defining said passage referred to as locking surfaces, said extendable bar supporting a blocking member or preferably a plurality of locking members to form a protection screen blocking said passage, to which said blocking member(s) are preferably removably fixed.

Locking by an actuator that may be hydraulic, electric, or preferably pneumatic is particularly simple and fast. Moreover, the device may be fitted to existing walls without adapting or converting them.

Here "locking surfaces" means surfaces that may be included in facing (parallel) internal or external walls forming a corridor defining a passage or surfaces of uprights of door or window frames or preferably within the thickness of the wall or masonry surfaces of a door or window frame situated outside the opening (usually referred to as a reveal).

Here "a screen for blocking " means a solid or preferably perforated surface, but one where the perforations do not allow a person to pass through and/or reduce the risk of projectiles of given size liable to thrown by hand through said blocking member passing through said screen, and/or where applicable between the various blocking members, notably projectiles of the type thrown by protesters at law enforcement personnel.

More particularly, said screen is formed by a single blocking member of flexible pliable material that is preferably perforated or a plurality of rigid solid blocking members spaced from each other to form a perforated screen.

Said screen advantageously is constituted by a plurality of blocking members constituted by rigid spaced slats, preferably parallel to each other and preferably perpendicular to said bar. In another embodiment, said screen is constituted by a net or a solid, flexible sheet material with anti-ballistic properties of the bullet-proof textile composite type.

A perforated screen has a two-fold advantage. Firstly, its weight is low, its overall dimensions when packaged before use are small, and its windage is low, thereby facilitating fitting it outdoors under windy conditions. Secondly, it does not shut off the passage completely and thus preserves the possibility of visual inspection of a situation by the operator from the other side of the screen.

Clearly said extendable bar may be positioned horizontally or vertically in the frame or the passage to be blocked, and said blocking member(s) may be disposed transversely, perpendicular to said bar.

The device of the invention may be installed by positioning said extendable bar(s) between the two locking surfaces, and then effecting blocking by extending the longitudinal ends of said bar(s) against said locking surfaces. The blocking member(s) may be prefixed to said bar(s) when using flexible material members such as a net or a textile material composite as referred to above that may be packaged in folded form. In contrast, if the blocking members are rigid members such as slats, they are advantageously mounted on the extended bar after locking said bar against the locking surfaces.

In a first embodiment, the device of the invention includes a single extendable bar.

Clearly, said blocking member or said plurality of blocking members is then advantageously rigid or adapted to be held in the form of a screen by said single extendable bar.

Because the blocking members of the device are removably mounted on said extendable bar(s) which in their retracted position have a short length and therefore a small overall size, the device of the invention in the form of a kit or set of members ready to be assembled may be packaged with a small overall size, which also contributes to facilitate its movement on site and its installation by intervention personnel.

More particularly, the device includes a plurality of said blocking members constituted by rigid slats, preferably two to five slats.

Said rigid slats are preferably disposed parallel to each other and preferably perpendicular to said bar.

More particularly, said extendable bar is disposed along a median transverse axis of said blocking member(s).

This single-bar type device requires to be fitted to a facade having a wall portion forming an abutment wall situated above and/or below said bar if it is disposed horizontally or laterally if said bar is disposed vertically, so that the bar and the slats are prevented from pivoting because the ends of said slats abut against said abutment wall.

Otherwise, in the absence of an abutment wall for the slats, this single-bar device may be juxtaposed to a second single-bar device with slats whose ends may be fixed to or preferably merely nested in the ends of the slats of the first device. This nesting constitutes an obstacle to pivoting of said slats and bars of the two devices. The two devices are disposed one above the other when blocking a corridor between two vertical locking surfaces or beside each other if the two locking surfaces are disposed horizontally one above the other.

To this end, the device advantageously includes a single extendable bar and a plurality of said blocking members constituted by rigid slats, preferably two to five slats, disposed parallel to each other and perpendicular to said bar, said slats having one end with a female shape and the opposite end with a complementary male shape so that the male shape at the end of the slats of a first device may be nested in the female shape of an identical second device.

However, these rigid slats may obviously be supported by a plurality of extendable bars, i.e. at least two extendable bars, disposed parallel to each other. The device may then be used without risk of pivoting of the slats even in the absence of an upper or lower wall surface situated above or respectively below the device, and the device may in particular be used to block a corridor.

In another embodiment, said protection screen is a flexible material screen adapted to be tensioned by means of a tensioning member tensioned both between said tensioning member and said first extendable bar and also between said two locking surfaces, said screen being fixed on one side to said bar and said tensioning member cooperating with the opposite side of said screen.

More particularly, said flexible material screen is constituted by a net.

Even more particularly, said tensioning member may be a cord or thread adapted to be held by one or more operators.

Said tensioning member preferably is constituted by a second extendable bar.

More particularly, said device therefore includes two of said extendable bars and a flexible material screen adapted to be stretched between said two extendable bars, to which two opposite sides of said screen are fixed.

However, it is possible to use a device with a single extendable bar supporting one side of a flexible screen, notably of the net type. However, the device must then be juxtaposed to and coupled to a second device in order to be able to fix the free opposite side of the flexible screen of the first device with a single extendable bar of a second device.

However, if the passage to be blocked requires the juxtaposition of a plurality of devices of the invention of the flexible material screen type tensioned between two of said extendable bars, notably to block a corridor to a sufficient height, a pre-assembled device is preferably used with three extendable bars supporting two of said screens of the flexible material type and the opposite sides of each screen fixed to one of said bars with a median bar inserted between the adjacent sides of two superposed screens to which median bar said sides of the two superposed screens are fixed.

In an embodiment that is preferred for its ease and speed of use, said extendable bar includes an actuator constituted by a tubular actuator body and at least one telescopic actuator rod extendable in the longitudinal direction of the tubular actuator body from the interior toward the exterior of said actuator body at one end of said actuator body.

The actuator may be a hydraulic, electric, or preferably pneumatic actuator given its qualities of lightness, small overall size and fast pneumatic actuation.

Said extendable bar preferably includes a pneumatic actuator self-powered by a cartridge of compressed air, preferably at a pressure of at least 50 bar, adapted to enable extension of said actuator rod, preferably several times, more particularly two to five times, said cartridge being rechargeable or replaceable.

Clearly, once the blocking device is in position, pressurizing the pneumatic actuator may be effected rapidly and manually, for example by simply pressing a button.

Said telescopic bar is preferably extendable by mechanical actuation, preferably manually, and at least at one end by pneumatic actuation by said cartridge.

In practice, the operator may manually pre-adjust the extension of the actuator rod(s) mechanically as a function of the approximate distance between the two locking surfaces by extending the device to a size less than the distance between the two locking surfaces, before positioning it between the two locking surfaces. The operator can then finalize the extension and lock the actuator rod(s) after placing the device between the two locking surfaces with one longitudinal end of the telescopic bar pressed against one of the two locking surfaces and effect locking to the second locking surfaces by extending the extendable rod at the other end using the pneumatic actuator. It is therefore clear that the pneumatic actuator is used only for the final locking corresponding to an extension of relatively short length over a distance of less than 10 centimeters (cm) or even less than 5 cm.

This embodiment has a two-fold advantage. Firstly, the time to fit the device during which the device must necessarily be placed between the two locking surfaces is minimized. It is essential to reduce this fitting time because it is a time during which the operator is positioned between the two locking surfaces and may therefore be exposed to thrown projectiles and/or other hazards from persons situated on the other side of the device and the locking surfaces relative to the operator and aiming to oppose the fitting of the device. The second advantage is that the pneumatic extension being of relatively short length, it requires only one cartridge of even smaller overall size. In practice, for an actuator body approximately 5 cm to 10 cm in diameter and approximately 80 cm to 110 cm long, with a pneumatic extension of 5 cm to 10 cm, a cartridge of air compressed to 50 bar has an overall size of 5 cm to 10 cm length and 1 cm to 4 cm diameter.

More particularly, said extendable bar includes an actuator constituted by a tubular actuator body and two telescopic rods extendable from the interior toward the exterior of said actuator body at respective ends of said actuator body, with:

- a first rod being adapted to be actuated mechanically and manually in extension and retraction; and
- the other rod being an actuator rod adapted to be pneumatically actuated in extension, at least partly, by means of one of said cartridges.

Said pneumatic actuator advantageously includes a device for rapid unlocking of said bar, this rapid unlocking device including at least one purge valve that, when opened, releases compressed air that is injected into a first chamber in the interior of said actuator body from said cartridge.

More particularly, said rapid unlocking device includes a second chamber in the interior of the actuator body reserved for compressed air in a third chamber, releasing of the compressed air contained in said first chamber allowing rapid retraction of at least one of said actuator rods caused by said reserve of compressed air contained in said third chamber and released into said second chamber because the pressure of the compressed air in said third chamber is higher than atmospheric pressure and lower than the pressure of the compressed air in said first chamber after injection of the compressed air contained in said cartridge before opening said purge valve.

Unlocking the bar by pneumatically retracting said actuator rods enable said blocking device to be removed from its location.

Said blocking member(s) are advantageously fixed to said extendable bar in a removable and interchangeable manner.

Clearly a plurality of designs of said protection members of different sizes may be available so that the user has the choice of adapting the design and/or the size of said protection member(s), namely said net, said slats or said panel, as a function of the operational context.

Said blocking members in the form of slats are advantageously themselves extendable lengthwise in the longitudinal direction of the slats. To this end, the slats are preferably constituted by two slats of different fixed lengths sliding one on the other. Clearly the longer slat can then be changed and the shorter slat fitted with longer slats of different size to those that they replace.

The adhesion of the ends of said extendable bar to said locking surfaces is enhanced by rubber or elastomer material pads.

Said solid or perforated rigid slats or panels may be produced in various materials such as plastic, carbon, preferably of the Kevlar type, wood, or metal, preferably aluminum.

The present invention also provides a kit ready to assemble to install a protection device of the invention, comprising:

a said extendable bar; and one or a plurality of said blocking members.

Figure 1B:
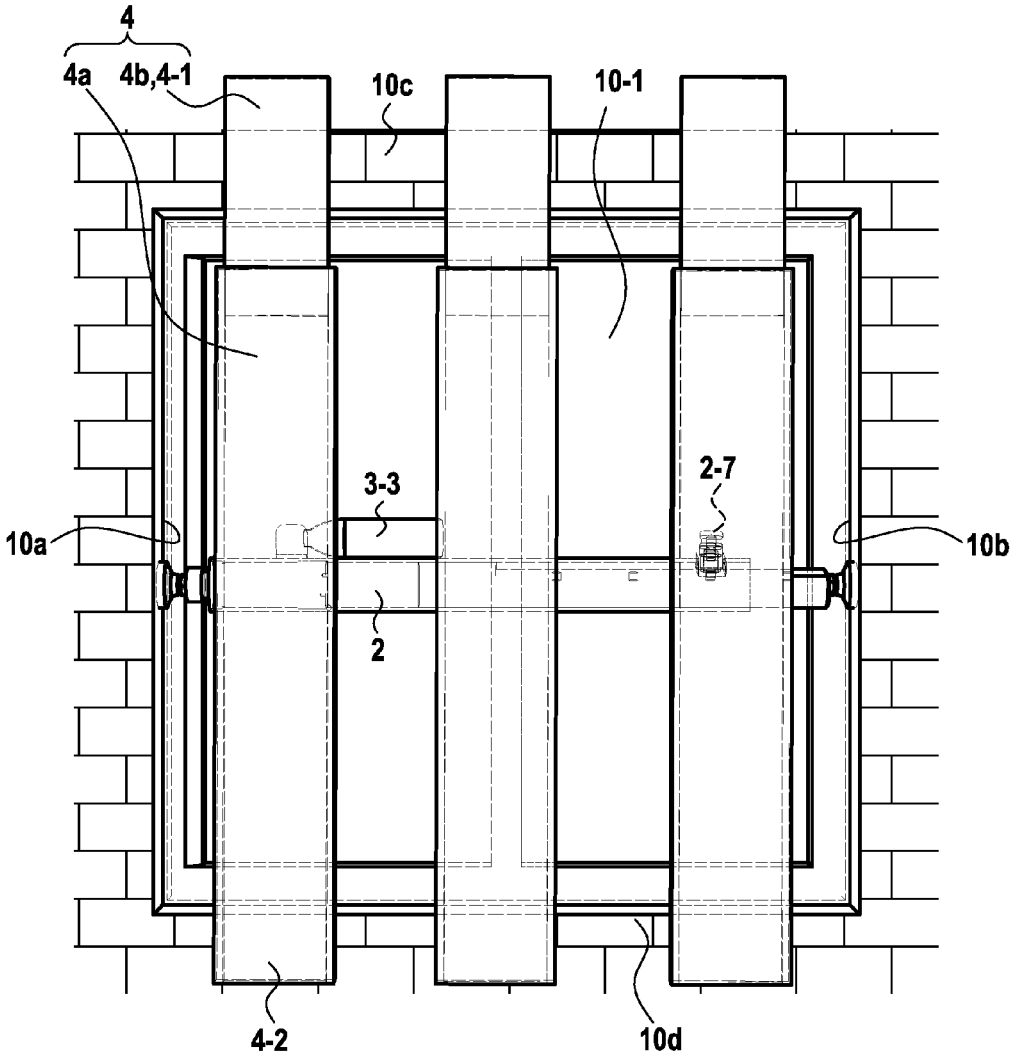
Figure 1C:
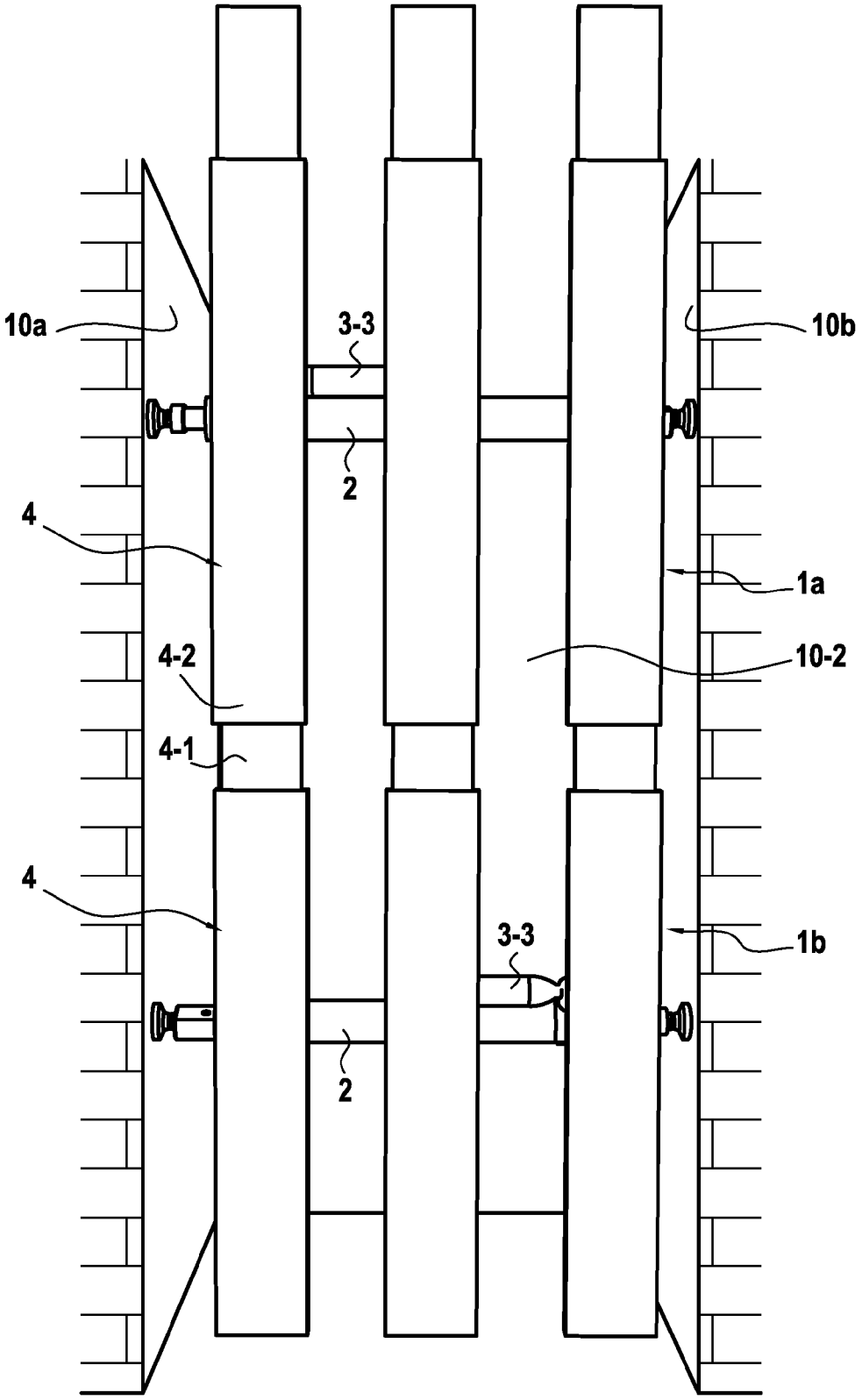

Other features and advantages of the present invention emerge more clearly from a reading of the following description, given by way of non-limiting illustration with reference to the appended drawings, in which:

FIGS. 1A, 1B, and 1C show a first variant of a protection device of the invention, with:

blocking members in the form of rigid slats disposed horizontally (FIG. 1A);

the device blocking a window (FIG. 1B); and two devices juxtaposed one above the other to block a corridor (FIG. 1C).

Figure 2A:
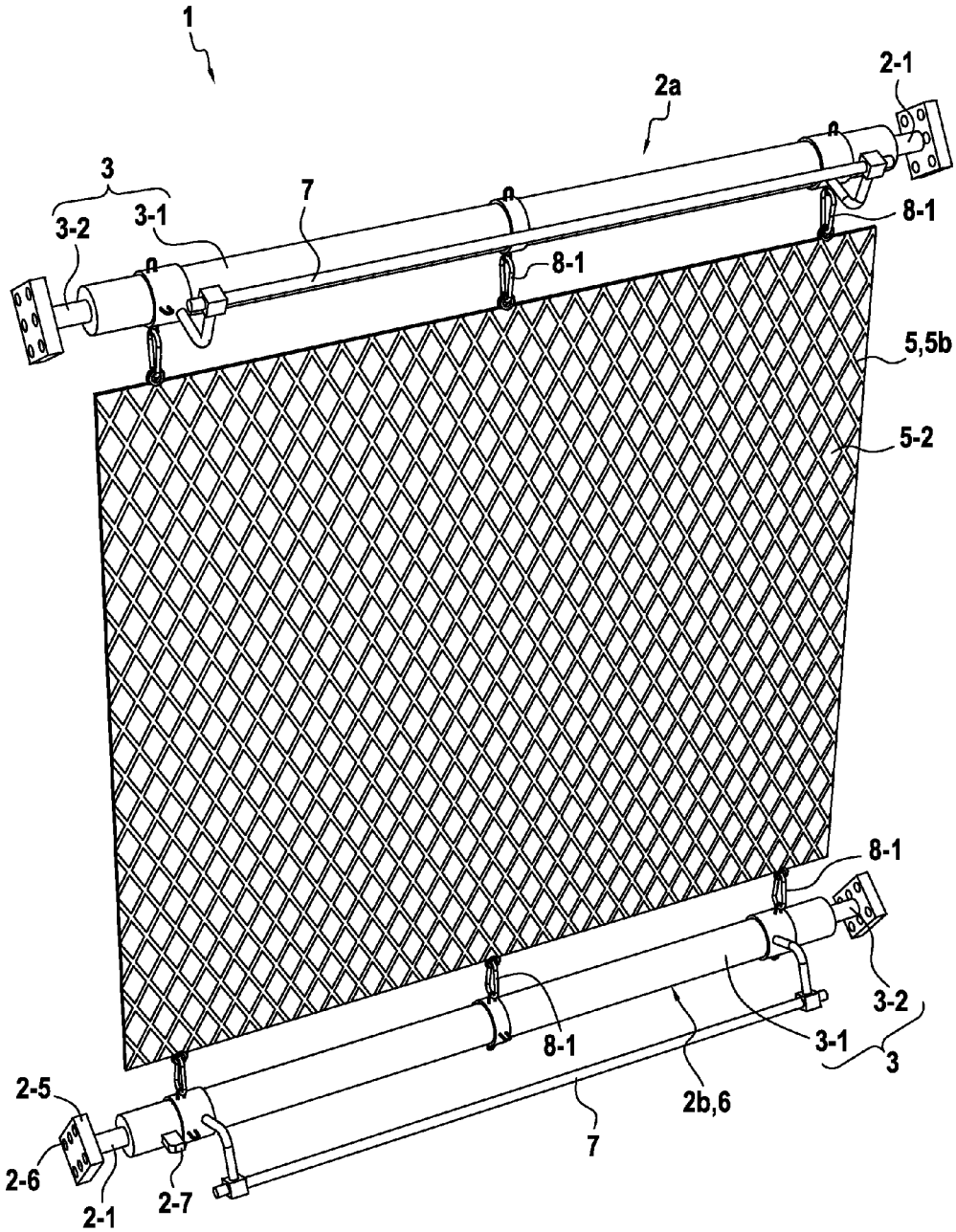
Figure 2B:
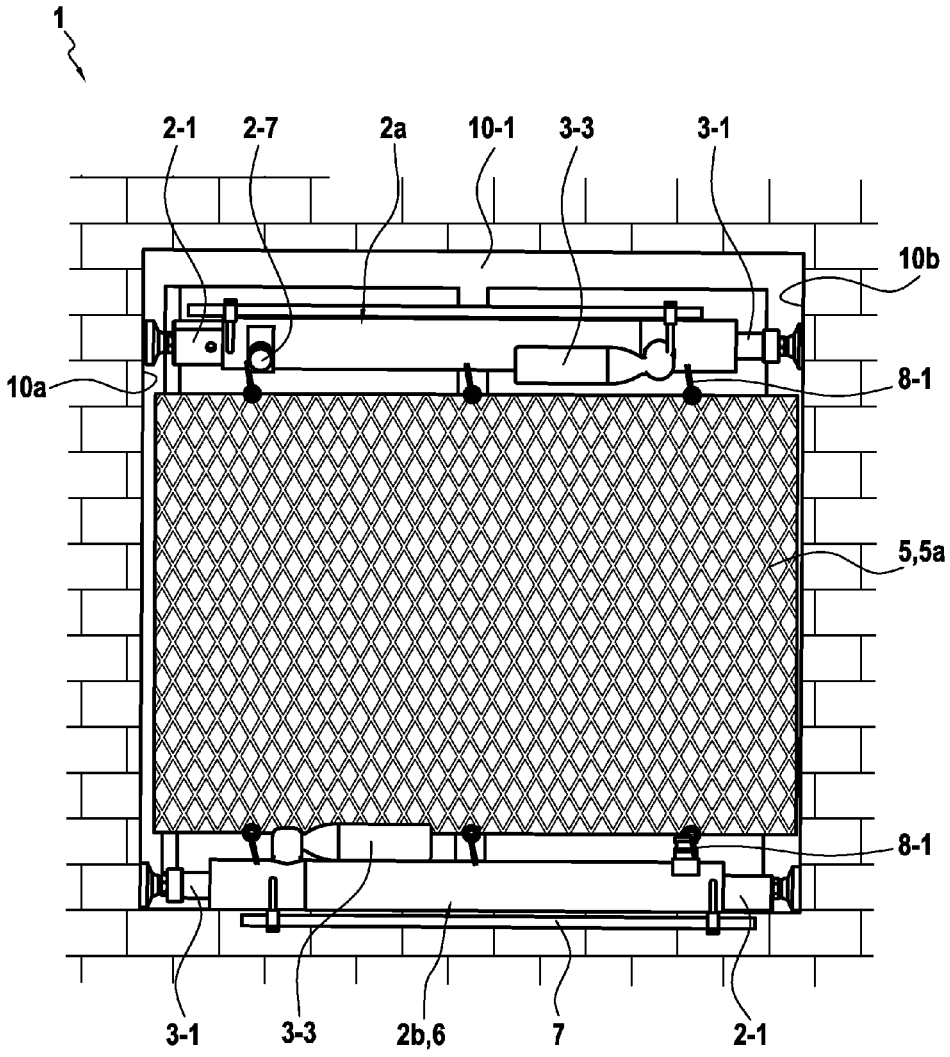
Figure 2C:
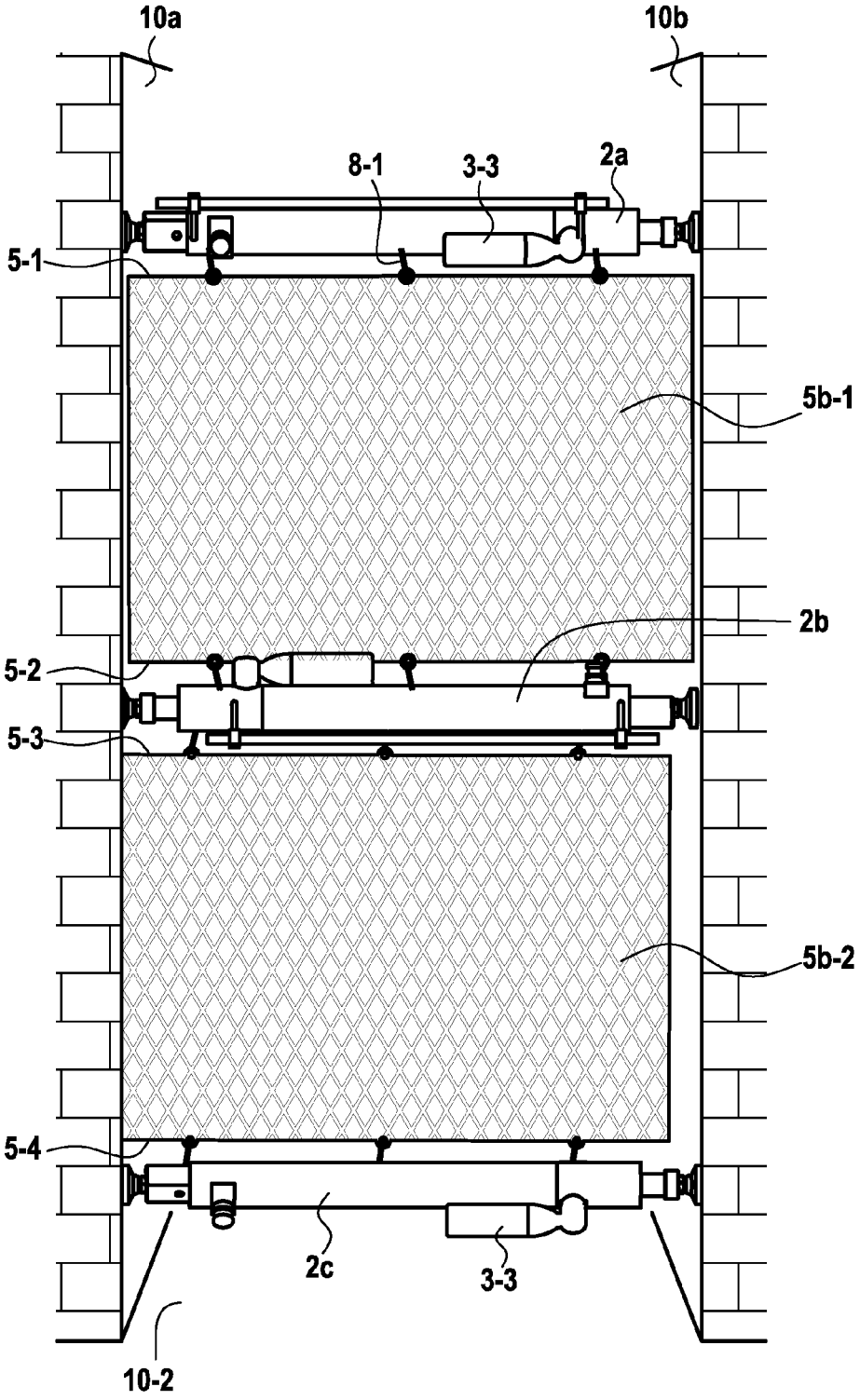

FIGS. 2A, 2B, and 2C show a second variant of a protection device of the invention, with:

a screen constituted by a net (FIG. 2A);

a protection screen over a window (FIG. 2B); and a device comprising a plurality of extendable bars and two superposed nets blocking a corridor (FIG. 2C).

Figure 3:
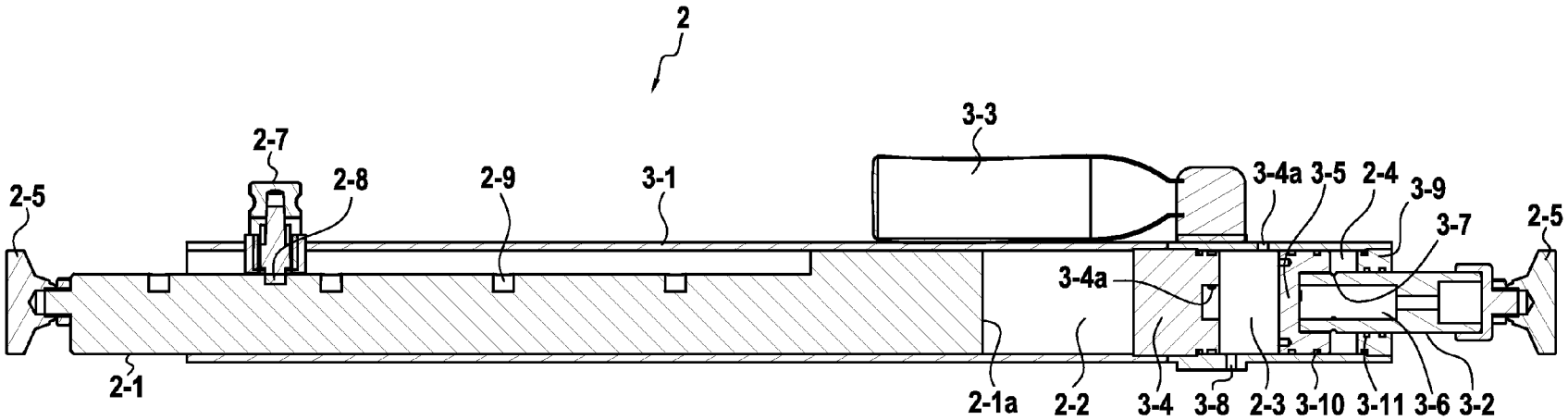

FIG. 3 shows in longitudinal section an extendable bar of a device of the invention.

The protection device of the invention shown in FIG. 1A includes a single extendable bar 2 to which are removably fixed by clips (not shown) and substantially in their middle parts three rigid slats 4 disposed perpendicularly to said extendable bar 2. The spacing 5-1 between the three slats 4 provides apertures in the screen 5*a* constituted by the set of three rigid slates 4. The distance 5-1 between two successive slats is less than or equal to the width of a slat.

Each slat 4 is formed of two complementary slat members 4*a*, 4*b* nested one within the other and sliding longitudinally one within the other. In FIG. 1A, the male member 4*b* protrudes from the female member 4*a* at both ends thereof. The user may have available a plurality of lengths of male member 4*b* in order to adapt them as a function of the dimensions of the opening of the passage to be blocked with the device of the invention.

In FIGS. 1B and 1C the male member 4*b* protrudes at only one end, with the result that the slat has two distinct ends, a male upper end 4-1 and a female end 4-2. Given the height of the window on the reveal of which the device is installed in FIG. 1B, a male member 4*b* protruding on only one side is sufficient. Moreover, this embodiment enables juxtaposed coupling of two devices one above the other to block a corridor 10-2, as shown in FIG. 1C, by nesting the male upper ends 4-1 of the slats of the lower device 1*b* in the female lower ends 4-2 of the same upper device 1*a* of the invention disposed above the device 1*b*.

The extendable bar 2 of the device is positioned at or near a position substantially half-way up the reveal of the window, within the exterior thickness of the wall exterior to the window 10-1.

It is necessary to adjust the length of the slats 4 so that, as shown in FIG. 1B, the ends 4-1 and 4-2 of each slat 4 abut against an upper abutment wall 10*c* and a lower abutment wall 10*d*, respectively, corresponding to facade portions situated above and below the reveal of the window 10-1. The slats extending above and below the reveal of the window prevent pivoting of the device as a whole as a result of manipulation by a person seeking to oppose this blocking and attempting to rotate the slats about the extendable bar 2 despite the end abutments 5 being locked against the lateral locking surfaces 10*a*, 10*b* of the reveal of the window.

The extendable bar 2 shown in FIG. 3 includes a hollow tubular longitudinal body 3-1 enclosing two extendable rods 2-1 and 3-2, one at each end.

The first rod 2-1 at the left-hand end is extendable and retractable by means of a mechanical device constituted by the combination of a member 2-7 for manually actuating a lug 2-8 cooperating with a plurality of locking notches or orifices 2-9 spaced along the length of the rod so as to be able to adjust the extended length of the rod 2-1 and lock it at a given extended length. Pulling on the member 2-7 for manually operating the lug 2-8 disengages the lug 2-8 from the locking notch 2-9 and releases the first rod 2-1, which may be manipulated manually and extended or retracted relative to the tubular body 3-1 by moving the lug 2-8 into another notch 2-9.

This first mechanical adjustment of the first rod 2-1 is effected manually and pre-adjusts the length of the extendable bar before use as a function of the size of the reveal of the window 10-1 or the corridor 10-2 to be blocked. Thus the second rod 3-2 at the other end of said bar, which constitutes a pneumatic actuator rod actuated by an onboard power supply constituted by a compressed air cartridge 3-3 fixed to said bar, may complete the extension of the bar and lock it against the two locking surfaces 10*a* and 10*b* of the reveal, by virtue of the effect of the pneumatic pressure.

The tubular body 3-1 has at its end a closure 3-9 that includes an orifice through which the second actuator rod 3-2 may slide in sealed manner by means of O-rings 3-11 during extension and retraction of said second actuator rod. The cylindrical internal cavity of the tubular body 3-1 has a first fixed block 3-4 inside it. Said second actuator rod 3-2 includes at its internal end a second block 3-5 fastened to said second actuator rod and sliding with it. The first block 3-4 and the second block 3-5 define with the cylindrical wall of the tubular actuator body 3-1 a first chamber 2-3 the volume of which varies according to the position of the second block 3-5. The second block 3-5 fastened to the internal end of the second actuator rod 3-2 defines with the fixed closure block 3-9 a second chamber 2-4 the volume of which varies inversely to that of the first chamber 2-3 when the second block 3-5 slides inside the actuator body 3-1. The second block 3-5 abuts against the closure block 3-9 at the end of the actuator body 3-1 when the second rod 3-2 is at the maximum extension, the volume of the first chamber 2-3 being the maximum volume whereas that of the second chamber 2-4 is zero. The second block 3-5 abuts against the first block 3-4 when the second actuator rod 3 is at the maximum retraction, the volume of the second chamber 2-4 being the maximum volume whereas that of the first chamber 2-3 is zero.

Said first block 3-4 also defines between the end 2-la of the rod 2-1 and said first block 3-4 a fourth chamber 2-2 that enables the first mechanical manual adjustment of the extension of the first rod 2-1.

The second rod 3-2 encloses a third chamber or internal reserve 3-6 that communicates with the second chamber 2-4 via an orifice 3-7 that is always open. Said second chamber 2-4 has a maximum volume $V_c$ and said internal reserve has a volume $V_b$ and is filled with gas compressed to a pressure $P_b$ such that:

$V_b \times P_b$ is less than $P_a$'$V_a$, $V_a$ being the maximum volume of the first chamber 2-3 when the second chamber 2-4 has zero volume and $P_a$ being the pressure in the first chamber 2-3 when it has the maximum volume $V_a$ after compressed air released by said cartridge 3-3 has been injected into it; and $(V_b+V_c)\times P_c=V_b\times P_b$ is greater than atmospheric pressure, $P_c$ being the volume in the combination of the second chamber 2-4 and the second internal reserve 3-6 when the second chamber 2-4 has the maximum volume $V_c$. In practice, $V_a$, $V_c$, and $V_b$ are such that $P_b$ is from 5 bar to 10 bar less than the pressure $P_a$ of the compressed air contained in the cartridge 3-3 injected into the first chamber 2-3, which is of the order of 50 bar to 150 bar.

Accordingly, to actuate the second actuator rod 3-2 in extension, the cartridge 3-3 is actuated to inject compressed air into said first internal chamber 2-3 via an orifice 3-4*a*. The increase in the pneumatic pressure in said first internal chamber 2-3 causes the second block 3-5 to slide and therefore the actuator rod 3-2 to slide to the maximum extension.

However, it should further be emphasized that the use of this actuator enables pressurization of the ends of the bars against the wall surfaces (referred to as locking surfaces) defining the passage to be blocked with a force approximately 30 kilonewtons (kN) greater than those generated by the manually-activated spring mechanisms described in the two documents mentioned.

Locking by means of an actuator is therefore not only simpler, but also enables use as an anti-intruder security device, or even to prevent defenestration, which distinguishes it from the uses envisaged in the two documents mentioned.

Rapid unlocking of the extendable bar 2 to remove the device after use is also effected pneumatically, in the following manner. A purge valve 3-8 of the first chamber 2-3 is opened to reduce the pressure in the first chamber 2-3, which causes the second block 3-5 to slide inside the tubular body 3-1 and therefore causes the actuator rod 3-2 to move until it abuts against the first block 3-4 inside the tubular actuator body 3-1. This retraction of the actuator rod 3-2 toward the interior of the actuator body 3-1 is effected by the compressed air contained in the internal reserve 3-6 of the actuator rod 3-2 that is introduced via the orifices 3-7 into the second chamber 2-4 disposed between the second block 3-5 and said end closure 3-9 at the end of the actuator body 3-1. The compressed air introduced into the second chamber 2-4 propels the second block 3-5 toward the interior of the actuator body 3-1 and therefore drives the actuator rod 3-2, which is fastened to it, toward the interior of the actuator body 3-1, given that the end closure block 3-9 through which the actuator rod 3-2 slides is fixed. By virtue of its O-ring 3-10 the second block 3-5 slides in sealed manner inside the tubular actuator body 3-1 with the cylindrical wall.

This system of autonomous pneumatic locking and unlocking is lighter, less bulky, and faster to use than mechanical systems, notably spring systems, not to mention its relatively low cost.

The dimensions of the cartridge 3-3 enable two to five extensions of the actuator rod 3-2. The extension stroke of the actuator rod 3-2 is predetermined by the distance between the first block 3-3 and the closure block 3-9 at the end of the actuator body 3-1. This distance is generally in the range 5 cm to 10 cm.

The actuator 3 is constituted by the components 3-1 to 3-11 referred to above.

Extending the first rod 2-1 and the second actuator rod 3-2 in the design shown in FIG. 3 enables the length of the extendable bar 2 to be increased by approximately 50% when the lug 2-8 cooperates with the first notch 2-9 (the leftmost notch 2-9 in FIG. 3). However, in an optimum use, the first rod 2-1 protrudes relative to the end of the tubular body 3-1 a distance identical to the maximum extended length of the actuator rod 3-2 at the opposite end.

At the ends of the rods 2-1 and 3-2 are elastomer blocks 2-5 having embossed members 2-6 on their external faces to encourage adhesion to the locking surfaces 10*a*, 10*b*.

To install a device of the embodiment of FIGS. 1A to 1C, the operator proceeds as follows, using a kit containing the extendable bar 2 and the three slats 4.

To install on a window reveal 10-1 as in FIG. 1B, the operator abseils down from the roof of the building and arrives laterally above the window, generally head first. He positions the end of the first rod 2-1, previously adjusted in extension as a function of the width of the reveal, pressed against the lateral surface 10*b* of the reveal of the window 10-1. He then locks the bar 2 by extending the actuator rod 3-2 against the opposite locking surface 10*a* of the reveal of the window by releasing the compressed air contained in the cartridge 3-3 within said first chamber 2-3.

In a preferred variant, the device is pre-assembled with the slats 4 fixed to the extendable bar 2 so that the time for which the operator is exposed in front of the opening is minimized, notably if the operator could be exposed to attack by hostile persons on the other side of the window, inside the building.

The male slat members 4*b* have been slid out beforehand so that the total length of the slats enables their upper ends 4-1 and lower ends 4-2 to abut against the upper wall 10*c* and the lower wall 10*d*, above and below the reveal of the window.

With the extendable bar 2 in the locking position, the slats 4 may be fixed onto the bar 2 by a system of clips (not shown).

In the first variant, the extendable bar 2 is preferably made of aluminum and the slats 4 of a carbon-based Kevlar-type material to combine lightness and mechanical strength.

In the second variant shown in FIGS. 2A to 2C, in which the screen is provided by a net 5*a*, the net is produced in high-strength polypropylene polymer with a mesh size in the range 25 millimeters (mm) to 40 mm, for example. This embodiment is advantageous because it is less bulky to transport given that the net may be folded up. In contrast, it requires the use of a tensioning member 6 in addition to the extendable bar 2*a* supporting the net. In practice, this tensioning member is advantageously a second extendable bar 2*b*. In this embodiment, to reduce the time of exposure of the operator in the frame of the reveal, longitudinal handles 7 are provided along the bars 2, and offset from them, so that it is possible to position the bar between the two locking surfaces 10*a* and 10*b* and against a first locking surface on one side, without the operator being visible from inside the window. The operator generally abseils from the roof of the building and first places a first extendable bar in the vicinity of the upper end of the reveal. The net is already prefixed by carabiners 8-1 to the first bar 2*a*, along one of its sides, and also pre-fixed along the side opposite the second bar 2*b*. After locking the first bar 2*a*, to which the second bar and the net are temporarily fixed, the second bar is released and the net unrolls. The operator then abseils further down to a position at or near the level of the lower end of the reveal of the window, and then presses the end of the first rod 2-1 against the corresponding locking surface 10*b* before pneumatically actuating the actuator rod 3-1 to lock it against the opposite locking surface 10*a* to lock the second bar. The weight of the second bar 2*b* applies tension to the net and holds it stretched flat.

This second variant of the device is advantageously fitted more quickly by an intervention team comprising two operators disposed one on each side of the window. The two extendable bars are placed symmetrically, i.e. with the actuator rods pressed against surfaces of the opposite lateral walls of the reveal of the window.

In FIG. 2C, to block a corridor to a sufficient height with the same kit constituted by nets and extendable bars, three extendable bars 2*a*, 2*b*, 2*c* are used, to which are fixed by carabiners 8-1 two nets which, once tensioned, form two screens 5*b*-1 and 5*b*-2. To the bar 2*b* positioned centrally, i.e. substantially half-way up the height of the device, there are fixed by carabiners 8-1 first sides 5-2 and 5-3 of the two nets 5*b*-1 and 5*b*-2, respectively. The other sides, which become the upper side 5-1 of the upper net 5*b*-1 and the lower side 5-4 of the lower net 5*b*-2, are fixed to bars 2*a* and 2*c*, respectively. Initially, the three bars are grouped one against the other, parallel to each other, with the two nets folded. The operator locks the first bar 2*a* at the top against the lateral locking surfaces 10*a*, 10*b* of the corridor 10-2, and then releases a tie holding the three bars together, the effect of which is to unroll the two screens and to tension them because of the weight of the two bars 2*b* and 2*c*. Thereafter the second or central bar 2*b* at mid-height and the third bar 2*c* at the bottom are locked against the same vertical locking surfaces 10*a*, 10*b* defining the corridor 10-2.

Because the nets are tensioned, the carabiners 8-1, even if opened unintentionally, cannot be separated from the net without unlocking the extendable bars 2.

In this regard, it should be noted that, as a security feature, opening the purge valves 3-8 of the extendable bar 2 requires the use of a dedicated tool such as a wrench or screwdriver with an end of non-standard shape.

The invention claimed is:

1. A self-contained protection device for temporarily blocking a passage such as a corridor, a door, or a window, the device comprising:

at least one telescopically extendable bar comprising a first end, and a second end; and at least one blocking member joined to the extendable bar to form a protection screen blocking said passage, wherein the at least one telescopically extendable bar comprises:

an actuator powered by a pneumatic mechanism, the actuator being directly mounted on the extendable bar, the actuator having a first rod, the first rod being telescopically extendable from the first end of the extendable bar to lock said extendable bar between first and second locking surfaces associated with first and second opposing sides of said passage, and the first rod being telescopically retractable into the first end of the extendable bar to unlock the extendable bar between the first and second locking surfaces, wherein:

said actuator comprises a tubular body and the first rod telescopically extends in a longitudinal direction of the tubular body from an interior toward an exterior of said tubular body;

said actuator is a pneumatic actuator powered by a cartridge of compressed air;

said cartridge is rechargeable or replaceable; and said cartridge is fixed to said extendable bar.

2. A device according to claim 1, wherein said screen is formed by a single blocking member of flexible pliable material that is perforated or a plurality of rigid solid blocking members spaced from each other to form a perforated screen.

3. The device according to claim 1, wherein the at least one telescopically extendable bar is a single telescopically extendable bar.

4. A device according to claim 1, wherein the at least one blocking member is a plurality of said blocking members constituted by rigid slats, said blocking members being removably fixed to said extendable bar.

5. The device according to claim 3, wherein the at least one blocking member is a plurality of rigid slats disposed parallel to each other and perpendicular to said extendable bar, each of said slats having a first end with a female shape and a second end with a male shape, wherein the male shape at the second end of each of the slats of a first device may be nested in the female shape of the second end of a corresponding slat of a second device.

6. A device according to claim 1, wherein said protection screen is a flexible material screen adapted to be tensioned by means of a tensioning member, tensioned between said tensioning member and said first extendable bar, said protection screen being fixed on one side to said bar and said tensioning member cooperating with the opposite side of said protection screen.

7. A device according to claim 6, wherein said flexible material screen is constituted by a net.

8. A device according to claim 6, wherein said device includes at least two extendable bars and at least one flexible material protection screen adapted to be tensioned between said two extendable bars to which two opposite sides of said protection screen are respectively fixed.

9. The device according to claim 1, wherein said extendable bar further comprises a second rod telescopically extendable from the second end, the second rod manually extendable by mechanical actuation from the second end.

10. The device according to claim 1, wherein said actuator includes an unlocking device adapted to unlock said bar, said unlocking device including at least one purge valve for releasing compressed air from a first chamber, the first chamber in an interior of a body of said actuator.

11. A self-contained protection device for temporarily blocking a passage such as a corridor, a door, or a window, the device comprising:

at least one telescopically extendable bar comprising a first end, and a second end;

an actuator powered by a hydraulic, electric, or pneumatic mechanism, the actuator being directly mounted on the extendable bar, the actuator having a first rod, the first rod being telescopically extendable from the first end of the extendable bar to lock said extendable bar between first and second locking surfaces associated with first and second sides of said passage, and the first rod being telescopically retractable into the first end of the extendable bar to unlock the extendable bar between the first and second locking surfaces; and at least one blocking member joined to the extendable bar to form a protection screen blocking said passage;

wherein said actuator comprises a tubular body and the first rod telescopically extends in a longitudinal direction of the tubular body from an interior toward an exterior of said tubular body;

wherein said actuator is a pneumatic actuator powered by a cartridge of compressed air, and said cartridge is rechargeable or replaceable;

wherein said actuator includes an unlocking device adapted to unlock said bar, said unlocking device including at least one purge valve for releasing compressed air from a first chamber, the first chamber in an interior of a body of said actuator; and wherein said unlocking device includes a second chamber in the interior of the body of the actuator and a third chamber in the interior of the body of the actuator, the third chamber holding compressed air, wherein a pressure of the compressed air in the third chamber is higher than atmospheric pressure and lower than a pressure of the compressed air in said first chamber such that a release of the compressed air from said first chamber causes a release of the compressed air from the third chamber into said second chamber, causing a rapid retraction of the first rod.

12. A kit comprising a plurality of components for use in assembling a device, the kit comprising:

at least one telescopically extendable bar comprising a first end, and a second end; and at least one blocking member joined to the extendable bar, wherein, the at least one telescopically extendable bar comprises:

an actuator powered by a pneumatic mechanism, the actuator being directly mounted on the extendable bar, the actuator having a first rod, the first rod being telescopically extendable from the first end of the extendable bar to lock said extendable bar in a selected position, and the first rod being telescopically retractable into the first end of the extendable bar to unlock the extendable bar from the selected position; and wherein extension of the first rod by a first activation of the actuator mounted on the extendable bar locks the device by pressing the extendable bar directly against and between a first and second opposing side surfaces of a passage in the selected position, and wherein retraction of the first rod by a second activation of the actuator mounted on the extendable bar unlocks the device by releasing the pressing of the extendable bar from between the first and second side surfaces in the selected position, wherein:

said actuator comprises a tubular body and the first rod telescopically extends in a longitudinal direction of the tubular body from an interior toward an exterior of said tubular body;

said actuator pneumatic mechanism is powered by a cartridge of compressed air;

said cartridge is rechargeable or replaceable; and said cartridge is fixed to said extendable bar.

13. The device according to claim 1, wherein said protection screen comprises a plurality of rigid solid blocking members spaced apart from each other to form a perforated screen, said blocking members comprising rigid slats, wherein the distance between two successive slats is less than or equal to a width of the slats, said blocking members being removably fixed to said extendable bar.

14. The device according to claim 1, wherein the at least one blocking member is a plurality of rigid slats.

15. The device according to claim 1, wherein said self-contained protection device can be locked and unlocked only by activation of the actuator by, respectively, pressing the actuator onto the locking surfaces, and releasing the actuator from the locking surfaces, without a need for any other locking or unlocking actions.

* * * * *